US006028513A

United States Patent [19]

Addy

[11] Patent Number: 6,028,513

[45] Date of Patent: Feb. 22, 2000

[54] WIRELESS ACTIVATION OF MULTIPLE ALARM DEVICES UPON TRIGGERING OF A SINGLE DEVICE

[75] Inventor: Kenneth L. Addy, Massapequa, N.Y.

[73] Assignee: Pittway Corporation, Chicago, Ill.

[21] Appl. No.: 09/031,809

[22] Filed: Feb. 27, 1998

[51] Int. Cl.[7] ..... G08B 1/08

[52] U.S. Cl. ..... 340/539; 340/692; 340/825.47; 340/531

[58] Field of Search ..... 340/539, 531, 340/825.44, 825.45, 825.46, 825.47, 825.48, 692; 455/38.3

[56] References Cited

U.S. PATENT DOCUMENTS

| | | | |
|---|---|---|---|
| 3,864,674 | 2/1975 | Worsham et al. | 340/539 |
| 3,914,692 | 10/1975 | Seaborn, Jr. | 340/539 |
| 4,383,257 | 5/1983 | Giallanza et al. | 340/825.44 |
| 4,692,742 | 9/1987 | Raizen et al. | 340/539 |

*Primary Examiner*—Donnie L. Crosland
*Attorney, Agent, or Firm*—Anthony R. Barkume, P.C.

[57] ABSTRACT

A method and apparatus for use in wireless alarm systems is provided which enable the simultaneous sounding of any or all alarm devices in the system upon sensing of an alarm condition by at least one of the alarm devices. The alarm devices are battery powered and include a reduced power transmitter which transmits an alarm signal, with an optional address corresponding to the initiating alarm device. The alarm signal is received by a central receiver in communication with a central control unit. The central control unit transmits a broadcast signal to any or all alarm devices in the system via the central transmitter. The broadcast signal optionally includes address information regarding the alarm devices to be activated. Reduced power receivers in the alarm devices receive the broadcast signal, determine if the address corresponds to its own and activates alarm notification and illumination systems accordingly. The illumination systems may be independent from the alarm devices and may provide guidance to those trapped during an emergency.

42 Claims, 5 Drawing Sheets

FIRST ALARM DEVICE (BEFORE SYNCHRONIZATION)

SECOND ALARM DEVICE (BEFORE SYNCHRONIZATION)

ALARM SYNCHRONIZATION SIGNAL

FIRST ALARM DEVICE (AFTER SYNCHRONIZATION)

SECOND ALARM DEVICE (AFTER SYNCHRONIZATION)

WIRELESS ACTIVATION OF MULTIPLE ALARM DEVICES UPON TRIGGERING OF A SINGLE DEVICE

BACKGROUND OF THE INVENTION

The present invention relates to wireless alarm and security systems and in particular to a method and apparatus for initiating an alarm condition at a plurality of alarm devices upon sensing of an alarm condition at one or more alarm device.

Recent regulatory requirements oblige fire alarm system installers to install systems that indicate the presence of a fire at all detectors in the system upon sensing a fire at any one detector. For example, if a fire is detected in a kitchen, then the kitchen fire detector must sound and indicate an alarm condition, and all other fire detectors throughout the premises must be triggered to indicate the alarm condition.

This requirement is relatively easily complied with in wired alarm systems by wiring all detectors to each other such that if any one detector detects an alarm condition, it initiates an alarm condition in any or all of the remaining detectors. However, for detectors that are wireless and powered by batteries, the problem becomes more complex since each detector must inform additional detectors that an alarm condition has occurred. Typical receiver circuitry located in the additional alarm devices in order to detect transmissions in compliance with FCC regulations (Part 15) for low power security/fire transmitters require a significant amount of current to operate. Thus, it becomes very difficult to maintain reasonable battery life while complying with low power transmission regulations. According to FCC regulations the permissible power of the transmitted signal is so low that receiver sensitivity must be excellent in order to obtain satisfactory range, and such a level of receiver sensitivity reduces battery life to unacceptable levels.

Therefore, it would be advantageous if an alarm condition sensed by one sensor in a wireless alarm system would selectively trigger an alarm condition in any or all of the remaining detectors in the system. Furthermore, such a detector should be relatively low cost, efficient in terms of current consumption and should be sensitive enough to detect transmissions, which are compliant with the requirements of FCC regulations Part 15.

In an alarm situation, such as a fire, it is often useful to provide additional guidance beyond a multidirectional siren to those caught in the fire. In alarm systems of the prior art, various indicators of an emergency situation are activated at once with relatively little if any direction given to occupants on how to most effectively avoid danger.

Therefore, it would be advantageous to provide an alarm system capable of providing instruction and guidance regarding means of escape to those trapped in an emergency situation indicated by the alarm condition.

An additional requirement imposed on alarm systems is that of "temporal sounding". The sound made during an alarm condition in most commercial alarm system and many private alarm systems consists of a sequence of tones separated by an absence of these tones. The requirement of temporal sounding mandates that the sequence of tones emitted by any detector during an alarm condition be synchronized to those emitted by all other detectors active at the same time. Without the temporal sounding requirement such alarms would result in an essentially cacophonous mixture of alternately sounding detectors that potentially add to the confusion during an emergency situation. Conversely, if the tone emitted during the alarm condition were substantially continuous, then temporal sounding requirements would no longer be applicable since the difference in synchronization would only be detectable at the instant the alarm devices were first activated rather than continuously throughout their activation period. The specific tolerances governing synchronization are generally specified and enforced by the authority having jurisdiction (AHJ) in which the alarm system has been installed. As with the requirement of activating multiple detectors in response to an alarm condition, the requirement of temporal sounding is straightforward with wired alarm system but somewhat more difficult in wireless alarm systems since each alarm device operates independently from the remaining alarm devices.

Therefore, it would be advantageous if an alarm system would satisfy temporal sounding and multiple detector sounding requirements in addition to being wireless, low cost and efficient in terms of current consumption.

SUMMARY OF THE INVENTION

In accordance with the present invention, a method for activating an alarm notification device in response to occurrence of an alarm condition is provided comprising the steps of sensing an alarm condition, transmitting an alarm signal in response to the alarm condition to a central control unit, receiving the alarm signal at the central control unit, transmitting a broadcast signal from the central control unit to a plurality of alarm devices in response to receipt of the alarm signal, receiving the broadcast signal by the plurality of alarm devices, and activating an alarm notification device associated with at least one of the alarm devices in response to receipt of the broadcast signal.

In further accordance with the present invention, the method of the present invention comprises the steps of specifying an identity of a source of the transmission of the alarm signal, specifying an identity of the alarm notification device to be activated in response to receipt of the broadcast signal, and providing human-detectable emissions from the alarm notification device.

In still further accordance with the present invention, the method of the present invention comprises the step of synchronizing the occurrence of an active period of the plurality of alarm devices operating at a duty cycle of less than one hundred percent, the operating duty cycle comprising the active period and an inactive period, thereby enabling the alarm notification device associated with the alarm devices to be substantially simultaneously activated in response to receipt of the broadcast signal.

In accordance with the present invention, an alarm device is presented which comprises an alarm sensor, a transmitter which transmits an alarm signal in response to detection of an alarm condition by the alarm sensor, a receiver adapted to receive a broadcast signal indicative of the alarm condition, and an alarm notification device coupled to the receiver adapted to activate in response to receipt of the broadcast signal. The receiver is substantially continuously enabled and requires either a substantially reduced amount of current or a reduced duty cycle receiver operating at a duty cycle of less than one hundred percent. The operating duty cycle comprises an active period and an inactive period. The reduced duty cycle receiver is adapted to have its active period synchronized to the active period of additional reduced duty cycle receivers, thereby enabling the alarm notification devices associated with the reduced duty cycle receivers to be substantially simultaneously activated with the alarm notification devices associated with additional reduced duty cycle receivers in response to receipt of the broadcast signal. The reduced duty cycle receiver may be a regenerative receiver, a superheterodyne receiver, a direct conversion receiver or a tuned radio frequency receiver. The alarm device can operate substantially entirely from batteries.

In further accordance with the alarm device of the present invention, the receiver is adapted to determine the identity of the alarm notification device from the broadcast signal. The alarm notification device is activated upon receipt of the broadcast signal and the transmitter is adapted to specify an identity of a source of the transmission of the alarm signal in the alarm signal.

In accordance with the present invention, an alarm system is provided which comprises a central control unit comprising means for receiving an alarm signal and means for transmitting a broadcast signal in response to receipt of the alarm signal. The alarm system further comprises a plurality of alarm devices each comprising means for sensing an alarm condition, means for transmitting the alarm signal in response to the alarm condition to the means for receiving the alarm signal of the central control unit, means for receiving the broadcast signal by the central control unit and means for activating an alarm notification device upon receipt of the broadcast signal.

In further accordance with the present invention, the alarm system comprises a body-wearable alarm device comprising a housing adapted to be worn on the body of a user, means for receiving a broadcast signal from a central control unit, and means for activating an alarm notification device upon receipt of said broadcast signal.

The alarm system may further comprise means for illumination adapted to illuminate an exit route or predetermined area in accordance with the means for selectively indicating devices to be activated upon activation by receipt of the broadcast signal. The means for receiving the broadcast signal may be substantially continuously enabled and requires a substantially reduced amount of current or comprise an operating duty cycle of less than one hundred percent. The operating duty cycle comprising an active period and an inactive period. The active period of the means for receiving adapted to be synchronized to the active period of the means for receiving in additional instances of the alarm devices, thereby enabling the alarm notification device associated with the means for receiving the broadcast signal to be substantially simultaneously activated with the alarm notification devices associated with the additional alarm devices in response to receipt of the broadcast signal.

DETAILED DESCRIPTION OF THE PREFERRED EMBODIMENT

Figure 1:
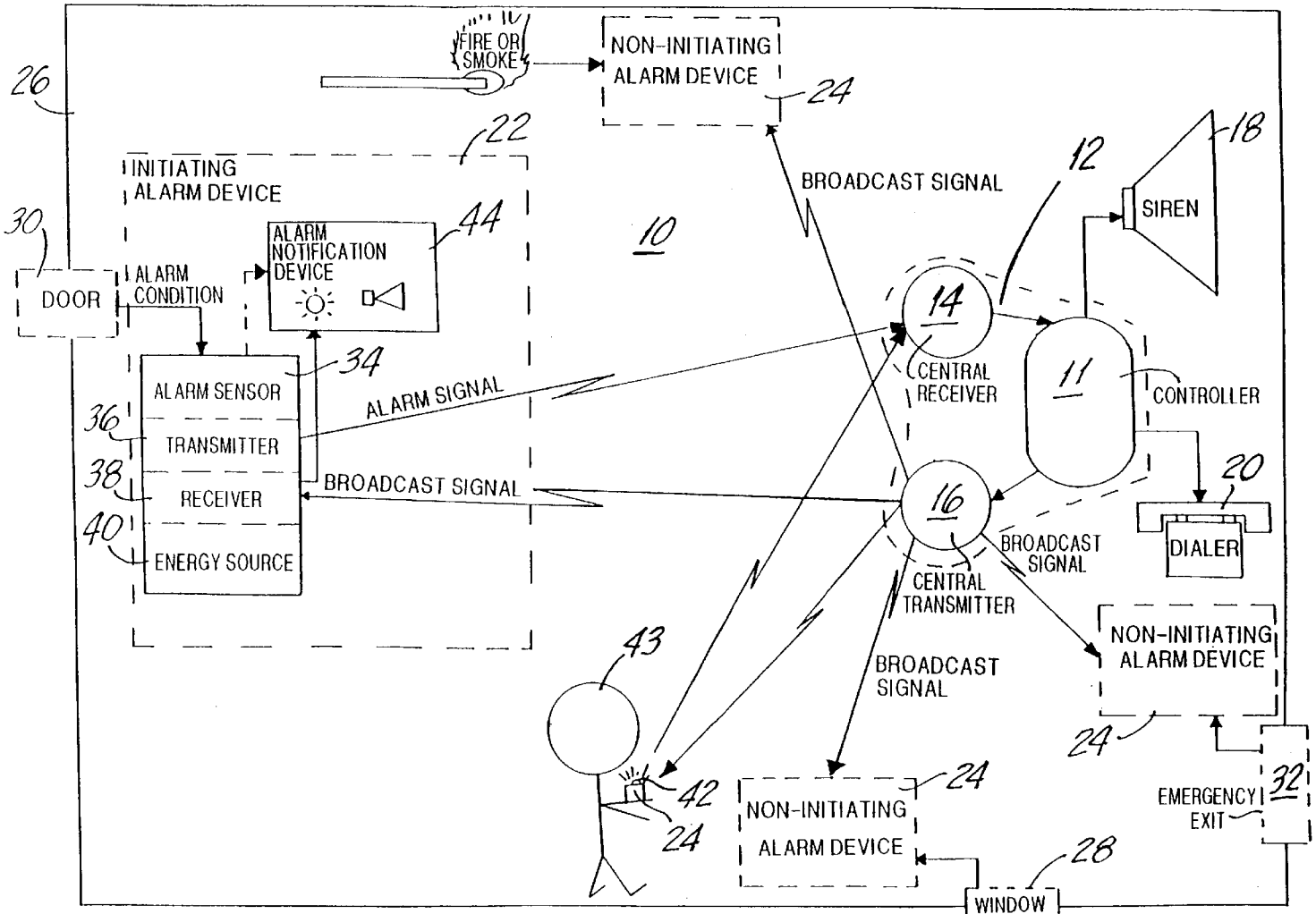
FIG. 1 illustrates a block diagram of an alarm system utilizing an alarm device of the present invention.

FIG. 1 illustrates a wireless alarm system 10 comprising a central control unit 12 (which comprises a central receiver 14, a central transmitter 16 and a controller 11), a siren 18, a dialer 20, and alarm devices, 22 and 24, of the present invention. In order to increase clarity of the description, any given alarm device may be referred to as an initiating alarm device 22, with respect to a particular alarm condition, if that alarm device sensed that particular alarm condition, or as a non-initiating alarm device 24 if it did not. However, both the initiating and non-initiating alarm devices may comprise substantially the same elements, and may function in substantially the same way by, for instance, sensing the presence of alarm conditions such as a fire, unauthorized entry into the building, radiation, the presence of predetermined gases, heat and other environmental parameters well known in the art. The wireless alarm system 10 is installed in a building 26 comprising windows 28, a door 30, and an emergency exit 32. The building 10 was chosen for illustrative purposes only and is not intended to limit the installation in any way.

The alarm device 22 comprises an alarm sensor 34, a transmitter 36, a receiver 38, an energy source 40, and an alarm notification device 44. The alarm sensor 34 senses the presence of alarm conditions such as a fire, unauthorized entry into the building, radiation, the presence of predetermined gases, heat and other environmental parameters well known in the art. The transmitter 36 is compliant with FCC regulations governing low power devices. The receiver 38 requires a minimum of current, which permits the alarm device 22 to operate solely on batteries, electromagnetic radiation (solar energy) or other limited, substantially equivalent energy sources well known in the art as the energy source 40. The transmitter 36 transmits an alarm signal, which represents the occurrence of the alarm condition, to the central receiver 14. The alarm notification device 44 comprises a siren or equivalent audible means for indicating the occurrence of the alarm condition well known in the art. The alarm notification device 44 may also be a light source or other equivalent means for illumination well known in the art.

The central receiver 14, controller 11, central transmitter 16, dialer 20 and siren 18 are interconnected to each other by conventional (i.e., wired) means. The central control unit 12 performs bidirectional wireless communication with the alarm devices using, for instance, signals within a Radio Frequency Band (which is essentially defined in accordance with FCC Part 15 as any frequency provided substantially no interference is created and the system is prepared to accept interference from other sources) or a Citizen's Band (typically from approximately 25 MHz to 28 MHz). Currently, typical Radio frequency ranges used are 300 to 400 Mhz and 902 to 928 Mhz, however, these are merely intended to provide an example and not a limitation on the application of the present invention in any way. For example, the ADEMCO 5800 system, manufactured by Alarm Device Manufacturing Co., 165 Eileen Way, Syosset, N.Y. 11791, uses frequencies of approximately 345 Mhz. In the preferred embodiment the alarm signal, transmitted by the initiating alarm device 22 in response to the alarm condition, is substantially within the Radio Frequency Band allocated to devices intended to operate in accordance with FCC Part 15 while the broadcast signal, transmitted by the central transmitter 16, is substantially within the Citizen's Band. However, the alarm signal and the broadcast signal could occupy the same band. For instance, both the alarm signal and the broadcast signal could occupy the Radio Frequency Band in accordance with FCC Part 15 or both could occupy the Citizens Band. Alternatively, the alarm signal could occupy the Radio Frequency Band in accordance with FCC Part 15 and the broadcast signal could occupy the Citizen's Band.

In the first embodiment, the alarm sensor 34 in the initiating alarm device 22 senses the alarm condition such as the opening of a window or the presence of heat or smoke from a fire. The alarm notification device 44 may be activated in the initiating alarm device 22 immediately following the sensing of the alarm condition or the alarm notification device 44 may be activated upon receipt of the broadcast signal. Which alternative is implemented largely depends upon the latency between the two alternatives in a given system (i.e., the difference in time between activation of the alarm notification device 44 using either alternative) and if this latency can be tolerated by any temporal sounding requirements which may exist. For instance, if the latency, or the time required to transmit the alarm signal, receive and process it by the central control unit and transmit the broadcast signal is approximately five seconds and the temporal sounding regulations require that alarm notification devices be synchronized to within one second, then the alarm sensor 44 in the initiating alarm device 22 must be activated upon receipt of the broadcast signal or else it will be out of synchronization with the rest of the system. Similarly, a personal illumination system 42 may optionally be activated upon sensing of the alarm condition or upon receipt of the broadcast signal and may be subject to different requirements of synchronization.

The transmitter 36 then transmits an alarm signal at reduced power within a radio frequency band to the central receiver 14. The reason for transmission at a typically reduced power generally permitted in order to comply with FCC regulations, is to reduce the amount of current required by the transmitter 36 in order to maintain battery life, and to reduce the cost of the transmitter. Conversely, the central receiver 14, which is typically powered by alternating current (AC), is capable of greater performance and sensitivity which is required in order to detect the alarm signal transmitted at reduced power. Since there are typically many alarm devices and only one central receiver 14, this balance of cost and operating current is generally acceptable.

Alternatively, the transmitter 36 could be designed to transmit the alarm signal at a higher power, which would relieve the need for increased sensitivity in the central receiver 14. However, such an embodiment would require greater energy in the initiating alarm device 22, which may render batteries an insufficient source of energy.

Upon receipt of the alarm signal by the central receiver 14, a message representative of the alarm signal is transmitted to the controller 11. The controller 11 then activates the siren 18 and the dialing of a fire or police department by the dialer 20 if appropriate. The controller 11 then initiates transmission of a broadcast signal representative of the alarm signal to all or a predetermined set of alarm devices via the central transmitter 16. The broadcast signal is transmitted at a relatively higher power than the alarm signal and within a Citizen's Band frequency range. The Citizen's Band is utilized since a relatively high power signal may be received using essentially passive detection techniques in the receiver 38 that are inexpensive and require a minimum of operating current. The broadcast signal optionally comprises address or identity information corresponding to the identity of individual or sets of alarm devices to be activated. The receiver 38, in any given alarm device, processes the address information and decides whether or not to activate the alarm condition. In addition, the alarm signal may optionally comprise address or identity information representing the initiating alarm device. Knowledge of the source of the alarm signal enables the central control unit 12 to determine the address of alarm devices, which should be activated.

Addressability of specific alarm devices via the broadcast signal enables the selective activation of alarm devices according to various parameters such as the nature and source of the alarm condition, which is provided by the alarm signal. For instance, in a large office building it may not be advisable to initiate an alarm condition in each alarm device, including those outside of a high-risk area, during the onset of the emergency. A more reasonable approach would be to activate only those alarm devices in the general vicinity of the alarm condition via their corresponding addresses. If the alarm condition is still present upon termination of a predetermined delay, then additional alarm devices could be activated in peripheral zones.

Furthermore, addressability of alarm devices permits a particularly useful application of devices comprising only the receiver 38 and a notification device 44 (in particular, an illumination system) For instance, the alarm notification device in alarm devices leading to the emergency exit 32 may be activated continuously or in a strobed or flashing fashion, thus providing guidance to occupants in their haste to escape the emergency. Strobing may be implemented by sequencing through a set of broadcast signals each uniquely addressed to individual alarm devices along the path to the emergency exit 32. Naturally the illumination device may take the form of battery powered emergency back-up lighting equipment which could be entirely separate from the alarm devices. Such backup lighting could be selectively activatable via the broadcast signal, thereby illuminating a safe path to the emergency exit 32.

Addressability of alarm devices could be implemented by various means well known in the art such as by dedicating one address bit for each alarm device in an address field contained in the messages of both the alarm and broadcast signals. Upon receipt of the broadcast signal, each alarm device checks the state of the bit dedicated to that specific alarm device to determine whether a response to that particular broadcast signal is required. The response to be performed by the alarm device and the characteristics of the source of the alarm signal are indicated by a status field in both the broadcast and alarm signals. Likewise, upon receipt of the alarm signal by the central control unit, the source of the alarm condition can be determined by checking the state of the address field. For instance, if the address field comprises 32 address bits then 32 individual alarm devices or groups or zones of alarm devices could be identified as either the source of the alarm signal or the intended recipient of the broadcast signal. Alternatively, each alarm device could be individually assigned a unique address or message identifying that alarm device as the intended recipient of the broadcast signal or source of the alarm signal. A zone of alarm devices would, for instance, comprise all alarm devices on one floor of a building. The address for each alarm device could be initialized during installation by setting dip switches in the alarm devices and/or central control unit, entering the address during a learning mode or other means well known in the art.

In addition, alarm devices 22 or 24 could be adapted to be worn by persons requiring specialized attention during alarm conditions such as children or disabled persons 43 (e.g., deaf, blind, physically handicapped) as shown in FIG. 1. The alarm device provides audible, visual or other sensory detectable output (e.g., vibration) both to the person wearing the device and/or those attempting to rescue those wearing the device. Similarly, the alarm condition could be initiated by the wearer selecting an emergency switch located on the alarm device. For instance, the alarm notification device in the bodily worn alarm device could vibrate in response to an alarm condition transmitted by the central transmitter 16, which would warn a deaf person wearing the device who is unable to hear the typical fire alarm. Similarly, the personal illumination system 42 in the bodily worn alarm device could provide a visible beacon, siren or another device capable of providing sensory detectable emissions, which would facilitate the rescue of the wearer by police, fire or other emergency personnel, particularly in smoke-filled areas.

Thus, the initiating and non-initiating alarm devices comprise receivers 38 having very low current consumption detection circuitry, which recognize the broadcast signal from the central transmitter 16 and initiates an alarm condition in response. Since the receiver 38 is substantially continuously enabled, the initiation of the alarm condition is essentially instantaneous upon receipt of the broadcast signal enabling each of the alarm devices to initiate the alarm condition substantially simultaneously. Simultaneous initiation of the alarm condition enables compliance with the temporal sounding requirement since each alarm device will activate the corresponding alarm notification device 44 at substantially the same time creating synchronization between each of the sequences of tones emitted from the alarm devices.

Figure 2:
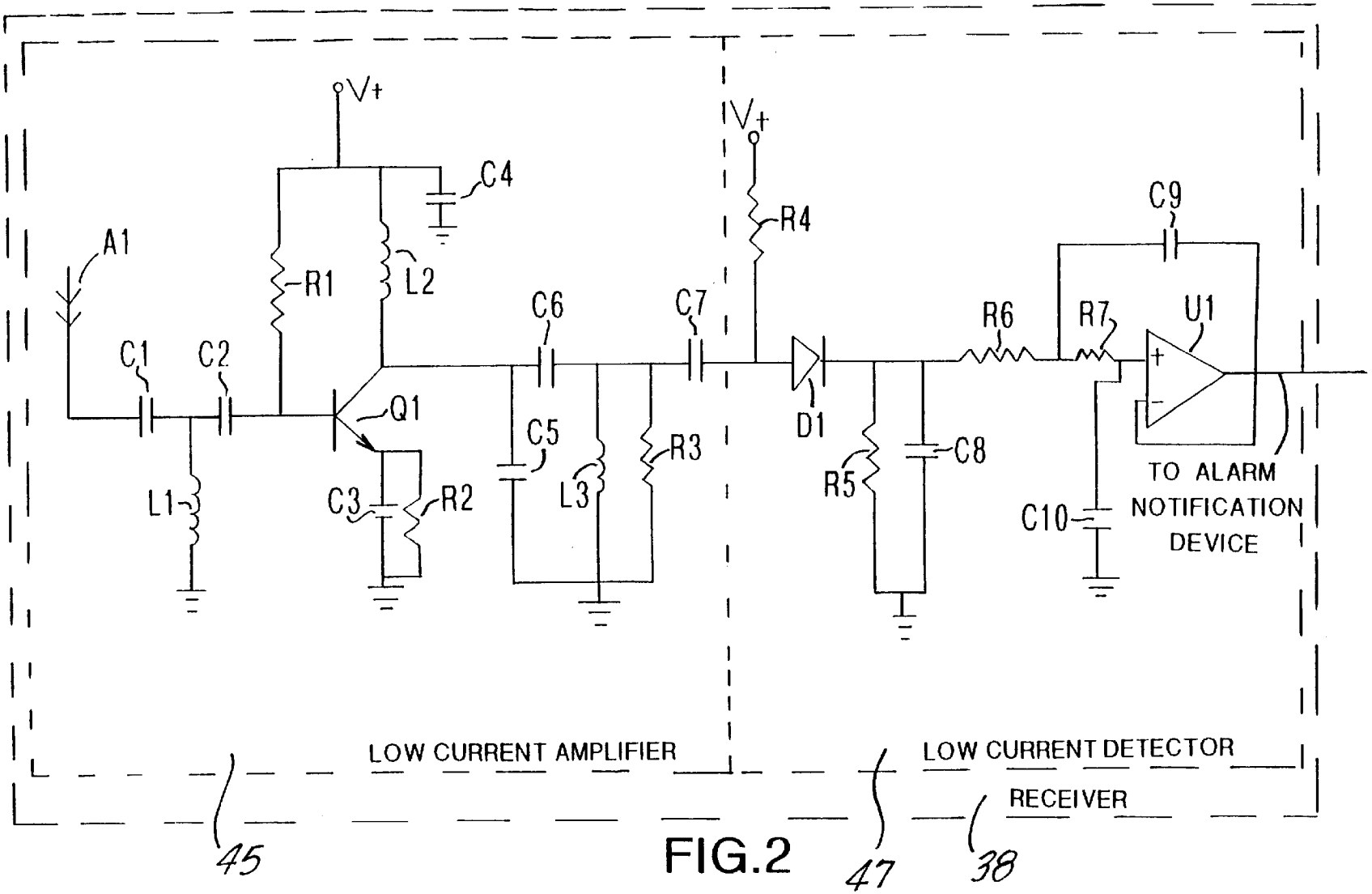
FIG. 2 illustrates an embodiment of a receiver in the alarm device of FIG. 1.

FIG. 2 illustrates an embodiment of the receiver 38 comprising a low current amplifier 45 and a low current detector 47. The low current amplifier 45 comprises an input matching circuit, an amplifier and an output matching circuit. The input matching circuit comprises a first capacitor C1 (approximately 4.7 pF), a second capacitor C2 (approximately 100 pF), and a first inductor L1 (approximately 39 nH). The input matching circuit ensures that characteristics, such as impedance, of antenna Al are substantially the same as the remaining circuitry in the receiver 38 in order to minimize reflections by means well known in the art. The amplifier comprises a first resistor R1 (approximately 220K), a second resistor R2 (approximately 100), a transistor Q1 (part number MMBR941 manufactured by Motorola Corporation), a second inductor L2 (approximately 330 nH), a third capacitor C3 (approximately 100 pF), and a fourth capacitor C4 (approximately 100 pF). The operation of the amplifier is well known in the art and is described in further detail in R. Dorf, *Electrical Engineering Handbook* (*1993*), which is hereby incorporated by reference. The output matching circuit comprises a fifth capacitor C5 (approximately 10 pF), a sixth capacitor C6 (approximately 4.7 pF), a seventh capacitor C7 (approximately 3300 pF), a third inductor L3 (approximately 39 nH), and a third resistor R3 (approximately 51). The output matching circuit is similar in function to that of the input matching circuit in that it matches the electrical characteristics between the amplifier and the low current detector 47.

The low current detector 47 comprises a detector and a buffer. The detector comprises a fourth resistor R4 (approximately 2.2M), a fifth resistor R5 (approximately 51k), an eighth capacitor C8 (approximately 330 pF), and a diode D1 (part number 2810). The detector responds to an amplified representation of the broadcast signal and outputs a decoded version of the on-off keying encoded broadcast signal for processing in or activation of the alarm notification device 44 by means well known in the art. The buffer comprises a sixth resistor R6 (approximately 100k), a seventh resistor R7 (approximately 100k), a ninth capacitor C9 (approximately 270 pF), a tenth capacitor C10 (approximately 270 pF) and an operational amplifier U1 (part number LT1495, manufactured by Linear Technology Corp.). The buffer functions to isolate the detector from the remaining circuitry in the alarm device 22 or 24. The values and part numbers of the various circuit components given parenthetically above are merely provided as examples of typical values and part numbers and are not intended to limit the scope of the present invention.

Figure 3:
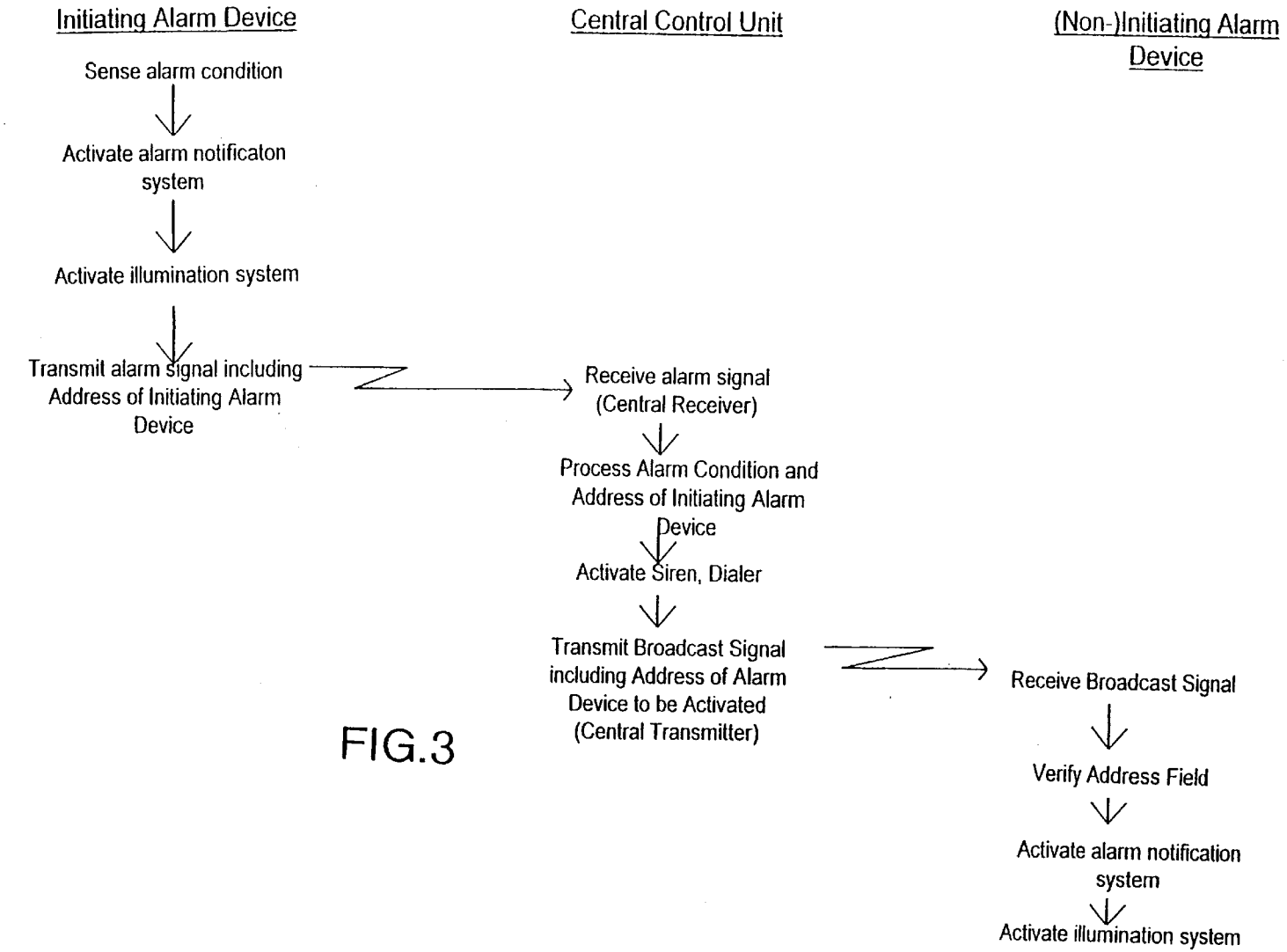
FIG. 3 illustrates a relational flowchart of the operation of the alarm system of FIG. 1.

FIG. 3 illustrates a flowchart of the operation of the wireless alarm system of the present invention. The process is begun when the alarm condition is sensed by the alarm sensor in the initiating alarm device. The initiating alarm device may optionally activate the alarm notification system at this time, or wait until the broadcast signal is received along with the non-initiating devices. The alarm signal is transmitted by the transmitter in the initiating alarm device to the central receiver with an optional address specifying the address of the initiating alarm device. The central receiver provides information contained in the alarm signal to the central control unit for further processing of the alarm condition and the address of the initiating alarm device. The central control unit may optionally activate the dialer and siren if appropriate. The central control unit then transmits the broadcast signal, optionally including the address of those alarm devices to be activated (which may be determined by accessing a pre-programmed look-up table in memory), via the central transmitter. The alarm devices receive the broadcast signal and verify that the address(es) specified in the broadcast signal correspond to its own address (i.e., address grouping). Naturally, any of the alarm devices may be programmed to respond to not only their own address but also those of additional alarm devices. The alarm device may then activate its alarm notification system if appropriate.

Figures 4A, 4B, 4C, 4D, 4E:
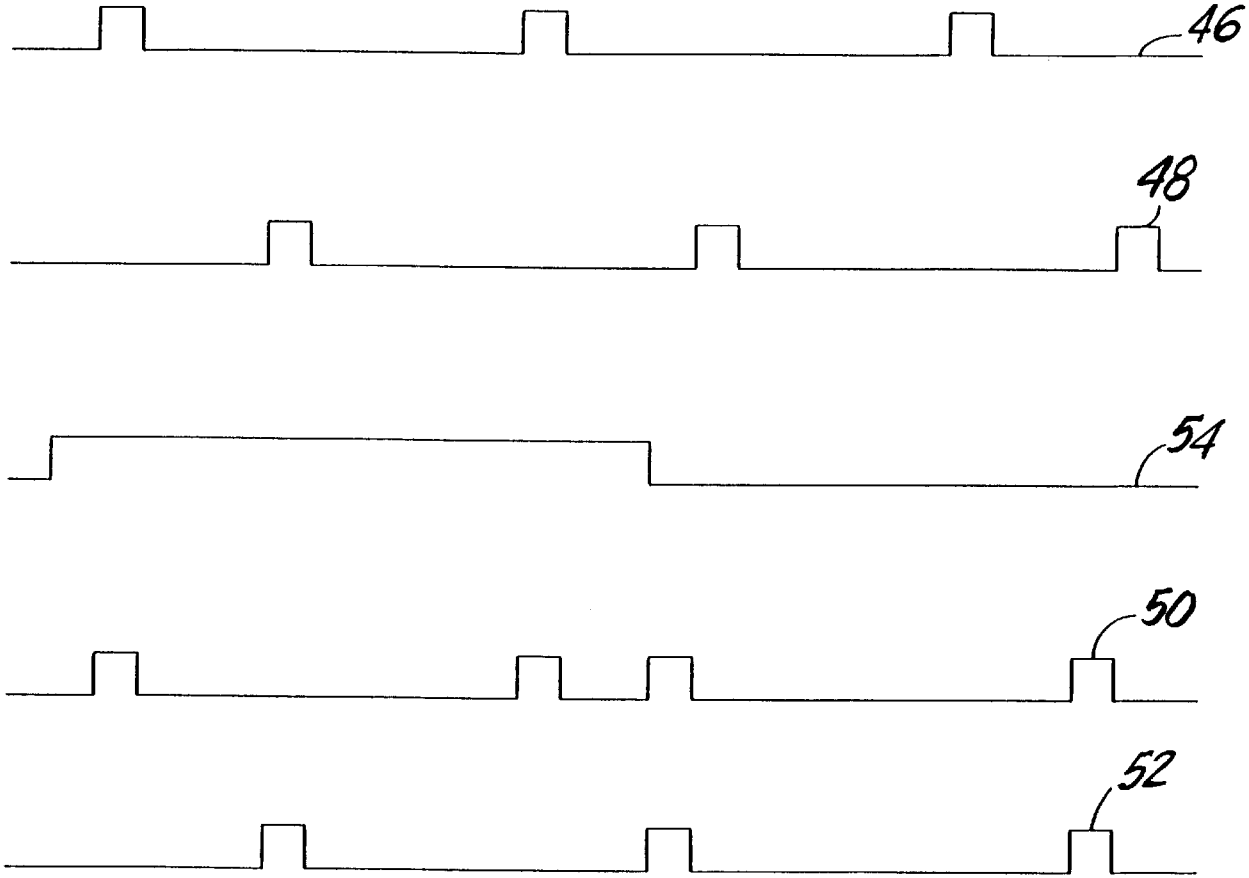
FIG. 4 illustrates the effect of a synchronization signal on waveforms representing active and inactive periods for two alarm devices of the present invention.

Alternatively, receivers 38 comprising greater sensitivity could be used such as a superheterodyning receiver, tuned radio frequency (TRF) receiver, direct conversion receiver, regenerative receiver or other equivalent receivers well known in the art. Greater detail regarding these designs is provided in U. Rohde, J. Whitaker, and T. T. N. Bucher, *Communications Receivers: Principles and Designs*, pp. 35–39 ($2^{nd}$ edition), and L. J. Giacoletto *Electronics Designers'Handbook*, sections 20–25 (1977), which are hereby incorporated by reference. In order to compensate for the greater operating current requirements of such receivers, they could be operated at a substantially reduced duty cycle. Waveforms representing the active and inactive periods for two alarm devices are illustrated in FIG. 4. Positive pulses in waveforms 46–52 indicate that period of time during which the particular alarm device is on or an active period. The active periods are separated by periods during which the alarm device is off or an inactive period. By reducing the duration of the active period a substantial amount of current is saved, thereby increasing the longevity of the batteries and allowing central transmitter 16 to operate at low power complying with FCC regulations for low power security/fire transmitters since the corresponding receiver 38 has high sensitivity although operating at a reduced duty cycle.

Figure 5:
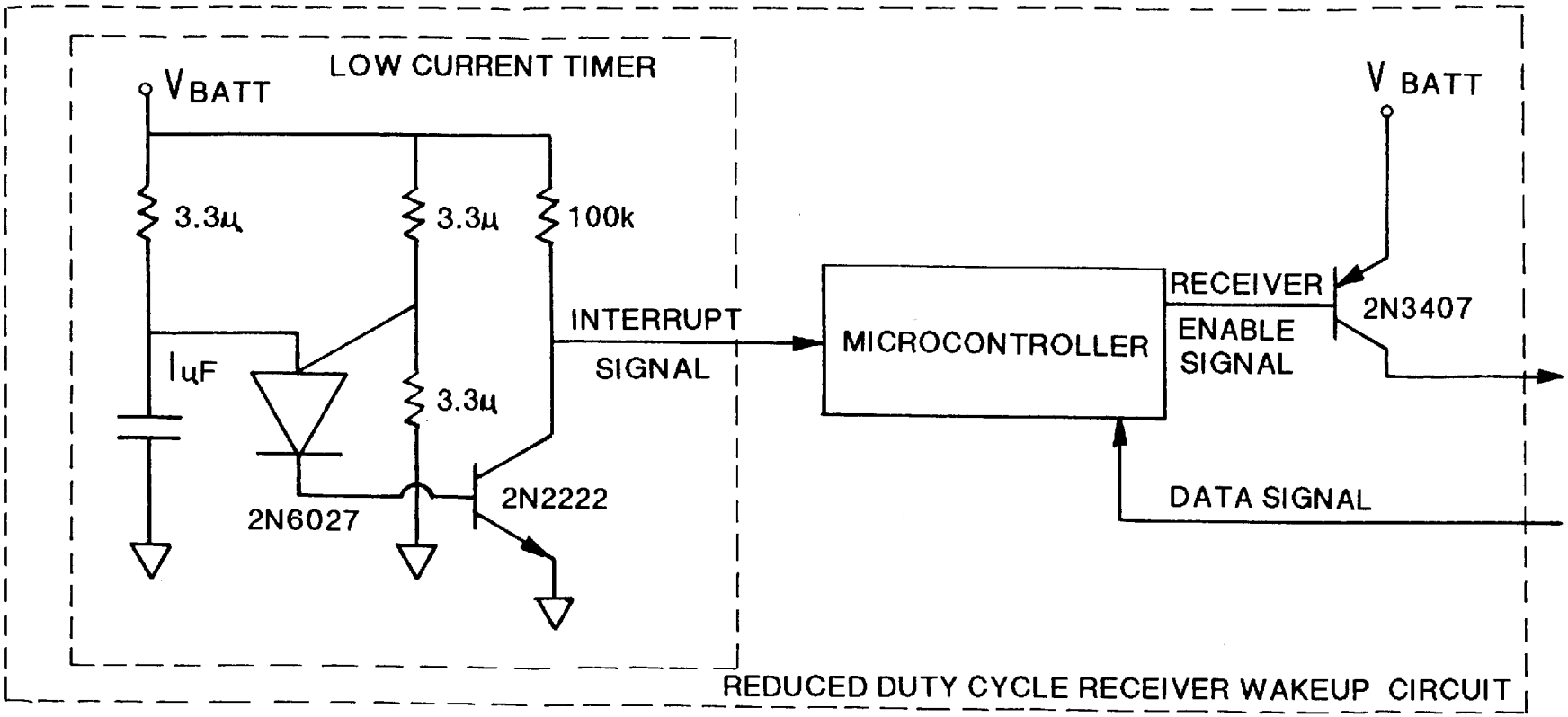
FIG. 5 illustrates a reduced duty cycle receiver wakeup circuit for use in conjunction with higher sensitivity receivers in a reduced duty cycle embodiment of the present invention.

FIG. 5 illustrates a reduced duty cycle receiver wakeup circuit contained in the receiver 38, which serves to periodically activate the higher sensitivity receivers listed immediately above. A low current timer functions as an oscillator by means well known in the art in order to provide periodic pulses on an interrupt signal to a microcontroller. The low current timer comprises four resistors (three of approximately 3.3M and one of approximately 100k), a capacitor (of approximately 1 uF), a programmable uni-junction transistor (part number 2N6027) and a transistor (part number 2N2222). Upon being interrupted, the microcontroller exits halt mode, in which it consumes a minimal amount of current (approximately 1 uA), and executes a series of program instructions in software. The program instructions cause the microcontroller to activate the receiver using a receiver enable signal and examine the data signal from the receiver circuitry to determine whether the broadcast signal has been received. If no broadcast signal is received during a predetermined time in which the microcontroller is not in halt mode (i.e., active time) then the microcontroller will reenter halt mode and wait for the next pulse from the low current timer to again bring the microcontroller out of halt mode. However, if the broadcast signal is received during the active time then the microcontroller will decode, process and execute the broadcast signal accordingly. A timer internal to the microcontroller is typically used to determine the duration of the active time. A transistor 2N3407 provides buffering and matches the electrical interface characteristics between the receiver enable signal output from the microcontroller and the receiver circuitry.

A significant problem is encountered by activating the receiver in such a non-continuous fashion. In order to comply with temporal sounding requirements, the active periods of each of the alarm devices must be substantially synchronized in order to enable corresponding sound emissions during the alarm condition to be substantially synchronous upon receipt of the broadcast signal from the central transmitter. This is not a problem if the receiver 38 is continuously enabled since, regardless of when the broadcast signal is transmitted, each of the receivers will be enabled and thus able to respond substantially instantaneously and, thus, simultaneously to the broadcast signal.

As shown by comparison between waveforms 46 and 48, the active periods for first and second alarm devices which are not continuously enabled are not synchronized with respect to each other. One solution to this synchronization problem is to use the leading or trailing edge of the alarm signal to provide an alarm synchronization signal 54, which could be transmitted from the central transmitter or one of the alarm devices acting as a master. As shown in FIG. 4, prior to receipt of the trailing edge in the alarm synchronization signal 54, the active periods of the first and second alarm devices are not synchronized. However, subsequent to the trailing edge the active periods are substantially synchronized. The alarm synchronization signal 54 causes the alarm devices to wake-up and stay awake for the duration of the alarm synchronization signal 54 and should be long enough to assure recognition by each of the alarm devices. For instance, if the alarm devices are active for one second every five seconds, then the alarm synchronization signal 54 should be greater than five seconds in order to ensure its recognition by each alarm device during its active period. At a predetermined time during the alarm synchronization signal 54, a master reset may be applied to digital counters responsible for timing the period between active periods of the alarm devices. Alternative substantially equivalent means well known in the art may be used to synchronize the active periods of multiple alarm devices that are not continuously enabled.

The alarm synchronization signal 54, as shown in FIG. 4, is merely intended to be illustrative. The actual signal to be used would be in a form suitable for wireless transmission to the alarm devices. In utilizing the low duty cycle receiver just described, sensitivity in the receiver is increased which permits a corresponding reduction in the power of the broadcast signal as well as the current required by the central transmitter.

The following modifications to the embodiments described above could be made while not exceeding the scope of the present invention:

1. encoding the alarm signal and/or the broadcast signal with Manchester Bi-phase encoding or other means well known in the art;
2. designing the receiver 38 to operate at a first current which is less than, greater than or substantially equivalent to a second current at which the central receiver 14 operates at; and
3. transmitting the alarm signal at a first power which is less than, greater than, or substantially equivalent to a second power at which the broadcast signal is transmitted at.

Although the invention has been shown and described with respect to best mode embodiments thereof, it should be understood by those skilled in the art that the foregoing and various other changes, omissions and additions in the form and detail thereof may be made therein without departing from the spirit and scope of the invention.

I claim:

1. In an alarm system comprising a plurality of wireless alarm emitting devices in wireless communication with a central control unit, each of said wireless alarm emitting devices operating at a duty cycle of less than one hundred percent, the duty cycle comprising an active period and an inactive period, a method of activating the wireless alarm emitting devices to perform an output function synchronously with each other comprising the steps of:

transmitting data comprising synchronization data from a central control unit;

receiving the transmitted data at each of the alarm emitting devices; and in response to the synchronization data, each of the alarm emitting devices synchronously performing an output function.

2. The method of claim 1 wherein each of the alarm emitting devices has a unique identity, and wherein the step of transmitting data further comprises the step of transmitting the identities of the alarm emitting devices that are to respond to the synchronization data.

3. The method of claim 2 wherein the synchronous output function of the alarm emitting device is an audible signal.

4. The method of claim 3 wherein the audible signal is a sequence of tones.

5. The method of claim 2 wherein the synchronous output function of the alarm emitting device provides a visual display.

6. The method of claim 5 wherein the alarm emitting devices that respond to the synchronization data operate in conjunction to indicate a preferred evacuation path.

7. The method of claim 1 wherein the synchronous output function is performed by resetting the occurrence of the active period by each alarm emitting device at the occurrence of a predefined event defined by the synchronization data.

8. A alarm system comprising:

a) a control unit comprising means for transmitting a signal, said signal comprising synchronization data, and b) a plurality of wireless alarm emitting devices, each of said plurality of alarm emitting devices comprising means for operating at a duty cycle of less than one hundred percent, the duty cycle comprising an active period and an inactive period, means for receiving the transmitted signal, and means for synchronously performing an output function in response to the synchronization data.

9. The system of claim 8 further comprising a sensor for detecting an alarm condition.

10. The system of claim 9 wherein the signal is transmitted in response to the detected alarm condition.

11. The system of claim 8 wherein the means for synchronously performing an output function comprises means for emitting an audible signal.

12. The system of claim 11 wherein the audible signal is a sequence of tones.

13. The system of claim 8 wherein the means for synchronously performing an output function comprises a visual display.

14. The system of claim 13 wherein the alarm emitting devices that respond to the synchronization data operate in conjunction to indicate a preferred evacuation path.

15. The system of claim 8, wherein said means for receiving comprises a regenerative receiver.

16. The system of claim 8, wherein said means for receiving comprises a superheterodyne receiver.

17. The system of claim 8, wherein said means for synchronously performing an output function in response to the synchronization data comprises means for resetting the occurrence of the active period by each alarm emitting device defined by the occurrence of a predefined event of the synchronization data.

18. In an alarm system comprising a plurality of wireless alarm emitting devices in wireless communication with a central control unit, each of said wireless alarm emitting devices operating at a duty cycle of less than one hundred percent, the duty cycle comprising an active period and an inactive period, and at least one sensor device in communication with the central control unit, a method for activating the alarm emitting devices in response to occurrence of an alarm condition, comprising the steps of:

a) sensing an alarm condition at the sensor device;

b) transmitting an alarm signal in response to said alarm condition to the central control unit;

c) receiving said alarm signal at said central control unit;

d) generating a broadcast signal in response to receipt of said alarm signal wherein the broadcast signal comprises synchronization data;

e) transmitting the broadcast signal to the plurality of alarm emitting devices;

f) receiving said broadcast signal by said plurality of alarm emitting devices; and g) performing an output function by the plurality of alarm emitting devices wherein the output is synchronously performed in response to the synchronization data.

19. The method of claim 18 further comprising the step of:

h) determining which of the alarm emitting devices are to perform an output function;

and wherein the generating step comprises the step of indicating the alarm emitting devices that should be signaled.

20. The method of claim 19 further comprising the step of i) identifying the location of the sensor device that transmits the alarm condition.

21. The method of claim 20 wherein the determining step is a function of the location of the sensor device that transits the alarm condition.

22. The method of claim 18 wherein the alarm emitting devices further comprise a timer.

23. The method of claim 22, wherein said step of receiving comprises the steps of:

periodically waking the alarm emitting device based on the state of the timer; and listening for a broadcast message.

24. The method of claim 23 wherein the timer of each alarm emitting device is reset by the synchronization data.

25. The method of claim 24 wherein the output function is repeated based on the timer value.

26. The method of claim 25 wherein the performed output is repeated for a predefined duration of time as indicated by the timer.

27. The method of claim 23 wherein the step of determining the alarm emitting devices to be signaled comprises determining the sequence of alarm devices to be signaled.

28. The method of claim 27 wherein the broadcast signal comprises a plurality of broadcast signals to be transmitted.

29. The method of claim 28 wherein the series of broadcast messages are transmitted by the central control unit to coordinate the alarm emitting devices to sequentially indicate a preferred path.

30. The method of claim 23 wherein the broadcast signal comprises synchronization data that coordinates the output of a visual signal and an audible signal.

31. The method of claim 23 wherein the output function of the alarm emitting device is an audible signal.

32. The method of claim 31 wherein the audible signal is a sequence of tones.

33. The method of claim 23 wherein the output function of the alarm emitting device is a visual display.

34. The method of claim 33 wherein the alarm emitting devices that respond to the synchronization data operate in conjunction to indicate a preferred evacuation path.

35. The method of claim 23 wherein the transmission of the synchronization data is in response to an alarm condition.

36. A alarm system for synchronously performing an output function at a plurality of alarm emitting devices comprising:

a) a sensor device comprising
- means for sensing an alarm condition; and
- means for transmitting an alarm signal in response to the alarm condition;

b) a control unit, comprising
- means for receiving the alarm signal;
- means for identifying the alarm emitting devices to be notified in response to the alarm signal;
- means for generating a plurality of broadcast signals, each of said broadcast signals comprising:
  - synchronization data, and
  - device identification data;
- means for transmitting said broadcast signals;

c) a plurality of wireless alarm emitting devices, each of said plurality of alarm emitting devices comprising:
- timer means;
- alarm emitting device identity storage means; processor means;
- means for performing an output;
- means for receiving the transmitted broadcast signal
  - wherein said means for receiving the transmitted broadcast signal is a reduced duty cycle receiver operating at a duty cycle of less than one hundred percent, said operating duty cycle comprising an active period and an inactive period as determined by the processor means and timer means, said reduced duty cycle receiver adapted to remain awake upon reception of the transmitted broadcast signal;
- means for determining whether the transmitted broadcast signal identifies the alarm emitting device, wherein if the alarm emitting device identity matches the transmitted broadcast signal identity, the alarm emitting device is responsive to the broadcast signal synchronization data; and whereby the means for performing an output function of each of the alarm emitting devices performs a synchronous output in response to the synchronization data.

37. The system of claim 36 wherein the alarm emitting devices further comprise timer reset means.

38. The system of claim 37 wherein the timer of each alarm emitting device is reset by the synchronization data.

39. The system of claim 38 wherein the output function is repeated based on the timer value and is reset at the end of the performance of the output function.

40. The system of claim 37 wherein the output function is repeated for a predefined duration of time as indicated by the timer.

41. The system of claim 36 wherein the series of broadcast signals are transmitted by the central control at an interval determined by the processor of the central control unit such that the synchronization data coordinates the alarm emitting devices to operate in conjunction to indicate a preferred path.

42. The system of claim 36 wherein the broadcast signal comprises a synchronization pulse that coordinates the output of a visual signal and an audible signal.

* * * * *